US012071875B2

(12) United States Patent
Baumgartner et al.

(10) Patent No.: US 12,071,875 B2
(45) Date of Patent: Aug. 27, 2024

(54) EXHAUST DEVICE AND METHOD OF MANUFACTURING THEREOF

(71) Applicant: Tenneco Automotive Operating Company Inc., Lake Forest, IL (US)

(72) Inventors: Frederick M. Baumgartner, Jackson, MI (US); Srinivasa N Rangan Chakravarthi, Jackson, MI (US); Jonar Mendoza, Ann Arbor, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 109 days.

(21) Appl. No.: 17/744,267

(22) Filed: May 13, 2022

(65) Prior Publication Data

US 2023/0366337 A1 Nov. 16, 2023

(51) Int. Cl.
*F01N 1/04* (2006.01)
*F01N 13/18* (2010.01)

(52) U.S. Cl.
CPC ..... *F01N 1/04* (2013.01); *F01N 13/1844* (2013.01); *F01N 2450/20* (2013.01); *F01N 2450/22* (2013.01); *F01N 2470/02* (2013.01)

(58) Field of Classification Search
CPC .... F01N 1/04; F01N 13/1844; F01N 2450/20; F01N 2450/22; F01N 2470/02; F01N 1/00; F01N 1/026; F01N 2470/08
USPC ..... 180/309; 181/252
See application file for complete search history.

(56) References Cited

U.S. PATENT DOCUMENTS

| | | | | |
|---|---|---|---|---|
| 3,522,863 | A | 8/1970 | Ignoffo et al. | |
| 4,111,279 | A | 9/1978 | Sterrett et al. | |
| 4,338,284 | A | 7/1982 | Ignoffo et al. | |
| 5,784,784 | A | 7/1998 | Flanigan et al. | |
| 5,898,140 | A | 4/1999 | Asao et al. | |
| 2008/0148722 | A1* | 6/2008 | Shirra | F01N 1/10 60/324 |
| 2015/0047922 | A1* | 2/2015 | Vollmer | F01N 1/24 181/264 |

(Continued)

FOREIGN PATENT DOCUMENTS

| | | | |
|---|---|---|---|
| DE | 19918989 | B4 | 4/2005 |
| EP | 0769651 | B1 | 7/2001 |

(Continued)

*Primary Examiner* — Kenneth J Hansen
*Assistant Examiner* — Kelsey L Stanek
(74) *Attorney, Agent, or Firm* — McGarry Bair PC

(57) ABSTRACT

An exhaust device includes a casing including an inlet configured to receive an exhaust gas, an outlet configured to discharge the exhaust gas, and a chamber disposed therein between the inlet and the outlet. The casing defines a longitudinal axis along its length. The exhaust device further includes an exhaust conduit at least partially received within the chamber of the casing along the longitudinal axis. The exhaust conduit includes an inner surface, an opposing outer surface, a plurality of perforations extending through the exhaust conduit from the inner surface to the outer surface, and at least one protrusion extending outwardly from the outer surface. The exhaust device further includes an absorptive material disposed on the outer surface of the exhaust conduit. The at least one protrusion of the exhaust conduit engages with the absorptive material in order to form an interference fit between the absorptive material and the exhaust conduit.

21 Claims, 11 Drawing Sheets

(56) References Cited

U.S. PATENT DOCUMENTS

| | | | | |
|---|---|---|---|---|
| 2017/0314435 | A1* | 11/2017 | Panther | F01N 1/083 |
| 2019/0178124 | A1* | 6/2019 | Ostromecki | F01N 1/083 |
| 2020/0088078 | A1* | 3/2020 | Zuver | F01N 1/026 |
| 2021/0207507 | A1* | 7/2021 | Madi | F01N 1/026 |

FOREIGN PATENT DOCUMENTS

| | | | | |
|---|---|---|---|---|
| JP | 2005273626 | A | * | 10/2005 |
| JP | 3940643 | B2 | | 7/2007 |
| JP | 2008240586 | A | | 10/2008 |
| JP | 2008240588 | A | | 10/2008 |
| JP | 2009209791 | A | * | 9/2009 |

* cited by examiner

EXHAUST DEVICE AND METHOD OF MANUFACTURING THEREOF

TECHNICAL FIELD

The present disclosure relates to an exhaust device, and in particular to an exhaust device for a vehicle and a method of manufacturing the exhaust device.

BACKGROUND

Exhaust silencing devices, such as resonators and/or mufflers, are commonly used in vehicular exhaust systems to reduce some of the raspy and high-pitched noises from the exhaust gas. Typically, in an exhaust silencing device, a sound absorbing material, such as glass wool, is filled in between an exhaust conduit and a casing (e.g., a resonator shell) for the purpose of deadening an exhaust sound by the sound absorbing function of the sound absorbing material. For assembling purposes, the sound absorbing material is rolled onto the exhaust conduit and the exhaust conduit is then fitted or stuffed inside the casing.

The stuffing of the exhaust conduit into the casing is generally performed vertically in a downward direction. During the stuffing of the exhaust conduit into the casing, the sound absorbing material rolled onto the exhaust conduit can slip off axially. As a result, the sound absorbing material may not be placed and disposed at a desirable location. The axial slip off of the sound absorbing material along an outer surface of the exhaust conduit can cause the exhaust silencing device to operate ineffectively. Therefore, due to sliding movement of the sound absorbing material, the exhaust silencing device may not be able to efficiently cancel out irritating buzzes and hums, as well as provide a smoother exhaust note.

SUMMARY

According to a first aspect, an exhaust device is provided. The exhaust device includes a casing including an inlet configured to receive an exhaust gas, an outlet configured to discharge the exhaust gas, and a chamber disposed therein between the inlet and the outlet. The casing defines a longitudinal axis along its length. The exhaust device further includes an exhaust conduit at least partially received within the chamber of the casing along the longitudinal axis. The exhaust conduit includes an inner surface, an opposing outer surface, a plurality of perforations extending through the exhaust conduit from the inner surface to the outer surface, and at least one protrusion extending outwardly from the outer surface. The exhaust device further includes an absorptive material disposed on the outer surface of the exhaust conduit. The absorptive material includes a first end facing the inlet of the casing and an opposing second end facing the outlet of the casing. The plurality of perforations of the exhaust conduit are disposed between the inlet of the casing and the second end of the absorptive material relative to the longitudinal axis. The at least one protrusion of the exhaust conduit engages with the absorptive material in order to form an interference fit between the absorptive material and the exhaust conduit. The interference fit prevents a relative movement between the absorptive material and the exhaust conduit at least along the longitudinal axis.

According to a second aspect, a method for manufacturing an exhaust device is provided. The method includes providing a casing including an inlet configured to receive an exhaust gas, an outlet configured to discharge the exhaust gas, and a chamber disposed therein between the inlet and the outlet. The casing defines a longitudinal axis along its length. The method further includes at least partially receiving an exhaust conduit within the chamber of the casing along the longitudinal axis. The exhaust conduit includes an inner surface, an opposing outer surface, a plurality of perforations extending through the exhaust conduit from the inner surface to the outer surface, and at least one protrusion extending outwardly from the outer surface. The method further includes disposing an absorptive material on the outer surface of the exhaust conduit. The absorptive material includes a first end facing the inlet of the casing and an opposing second end facing the outlet of the casing. The plurality of perforations of the exhaust conduit are disposed between the inlet of the casing and the second end of the absorptive material relative to the longitudinal axis. The method further includes engaging the at least one protrusion of the exhaust conduit with the absorptive material in order to form an interference fit between the absorptive material and the exhaust conduit. The interference fit prevents a relative movement between the absorptive material and the exhaust conduit at least along the longitudinal axis.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

Figure 1:
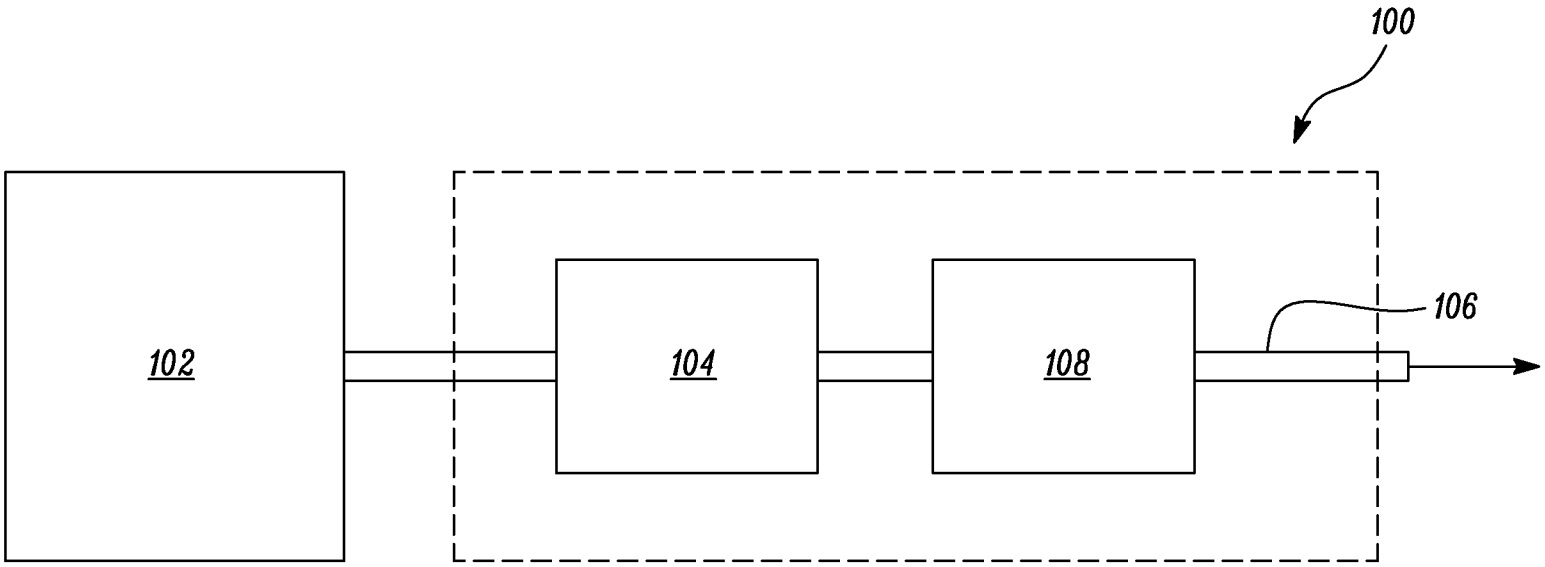
FIG. 1 is a schematic representation of a vehicle exhaust system, according to an embodiment of the present disclosure.

The following description is merely exemplary in nature and is in no way intended to limit the disclosure, its application, or uses. Referring now to the drawings in which like reference numerals designate like or corresponding parts throughout the several views, there as shown in FIG. 1. Referring to FIG. 1, a schematic representation of a vehicle exhaust system 100 is illustrated. The vehicle exhaust system 100 will be hereinafter interchangeably referred to as the "system 100". The system 100 can be fluidly coupled to an engine 102. The engine 102 can be any internal combustion engine powered by a fuel, such as diesel, gasoline, natural gas, and/or a combination thereof. Accordingly, the system 100 receives exhaust gas generated by the engine 102.

The system 100 can include a number of downstream exhaust components 104 fluidly coupled to the engine 102. The exhaust components 104 can include a number of systems/components (not shown), such as a Diesel Oxidation Catalyst (DOC), a Diesel Exhaust Fluid (DEF) unit, a Selective Catalytic Reduction (SCR) unit, a particulate filter, an exhaust pipe, an active valve, a passive valve, an Exhaust Gas Heat Recovery System (EGHR), and the like. The exhaust components 104 can be mounted in various different configurations and combinations based on application requirements and/or available packaging space. The exhaust components 104 are adapted to receive the exhaust gas from the engine 102 and direct the exhaust gas to the external atmosphere via a tailpipe 106. The exhaust components 104 are adapted to reduce emissions and can also be used for thermal management.

In another embodiment, the engine 102 can be part of a hybrid system, i.e., the engine 102 can be operatively coupled with an electric motor and a battery. Further, the exhaust components 104 of the system 100 can be operational only when the engine 102 is burning fuel and not operational when the engine 102 is not running.

The system 100 also includes an exhaust device 108 provided in fluid communication with the exhaust components 104 and the tailpipe 106. In some embodiments, the exhaust device 108 is an acoustic damping exhaust device 108, such as a muffler or a resonator. In some other embodiments, the exhaust device 108 can additionally perform exhaust treatment functions. In the illustrated embodiment, the exhaust device 108 is disposed downstream of the exhaust components 104 and upstream of the tailpipe 106. In other embodiments, the exhaust device 108 can be disposed in any sequence with respect to each of the exhaust components 104 and/or the tailpipe 106, based on application requirements. In some cases, the exhaust device 108 is adapted to dampen resonance frequencies generated during operation of the engine 102 and the system 100. In some embodiments, the exhaust device 108 can include catalyst substrates for exhaust gas purification in addition to exhaust gas noise attenuation. In another embodiment, the system 100 can include hybrid design that combines the exhaust components 104 and the exhaust device 108 to include both emissions and acoustics tuning elements.

Figure 2:
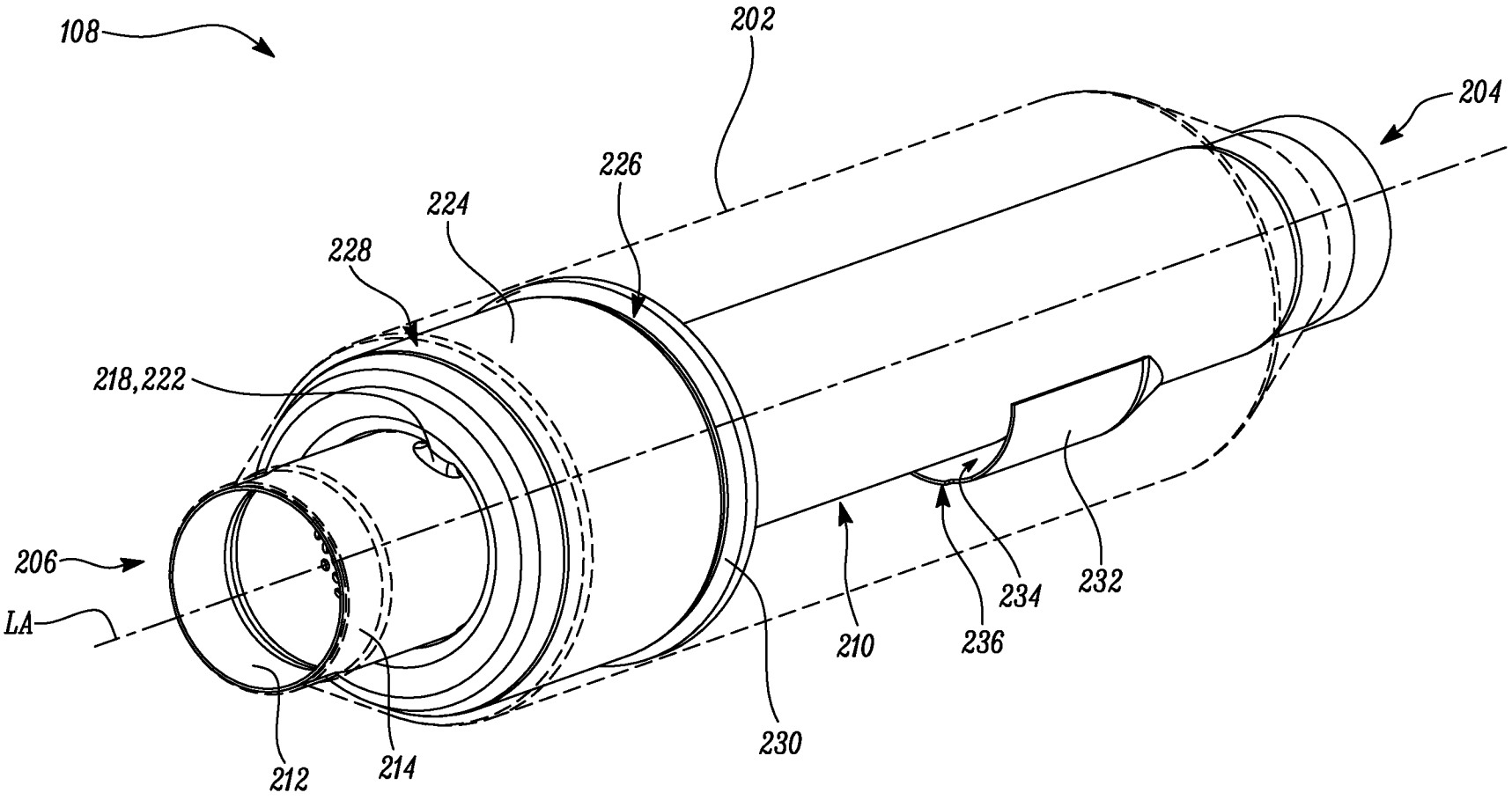
FIG. 2 is a perspective view of an exhaust device of the vehicle exhaust system of FIG. 1, according to an embodiment of the present disclosure.
Figure 3:
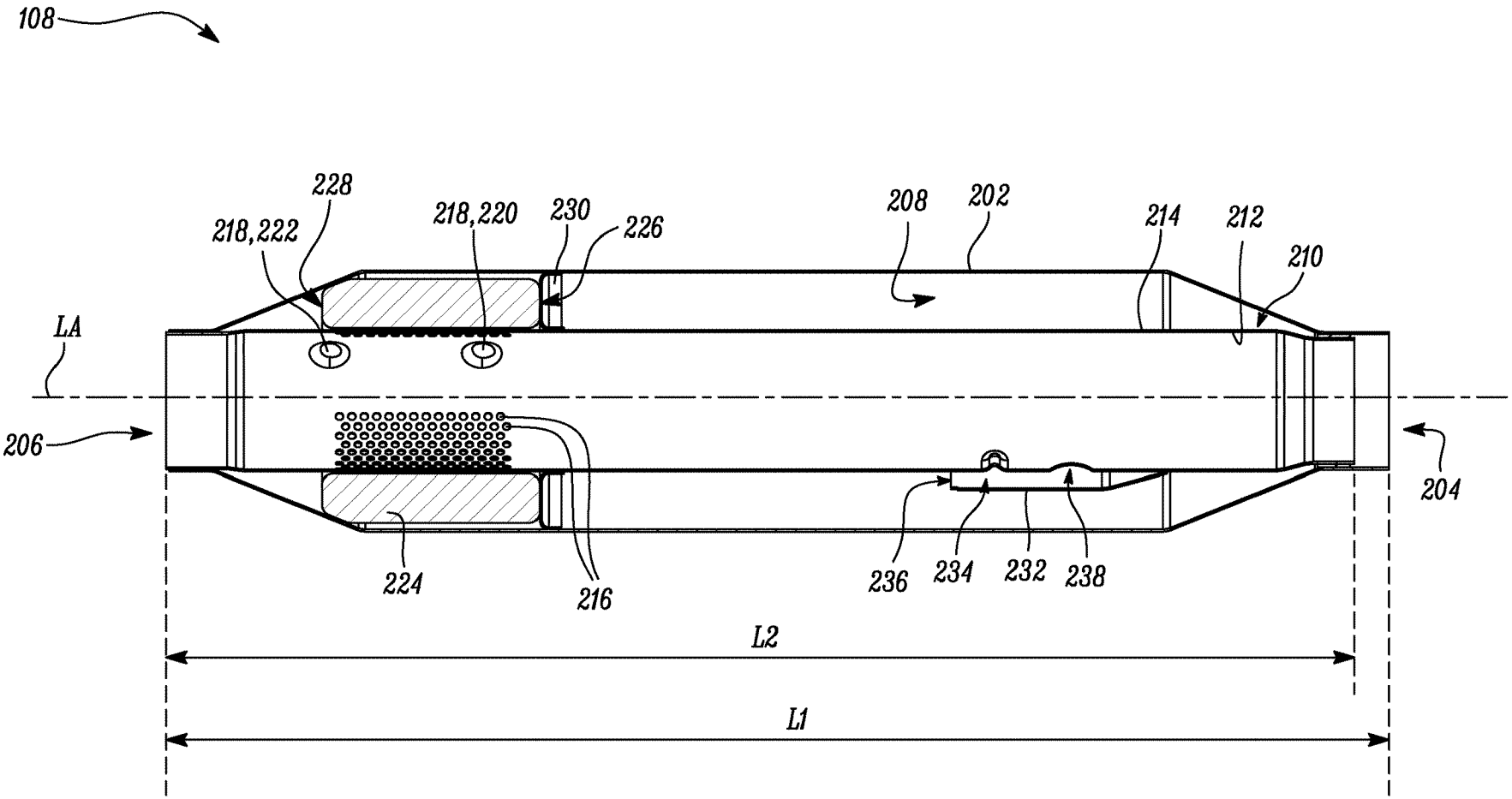
FIG. 3 is a side sectional view of the exhaust device of FIG. 2, according to an embodiment of the present disclosure.
Figure 4:
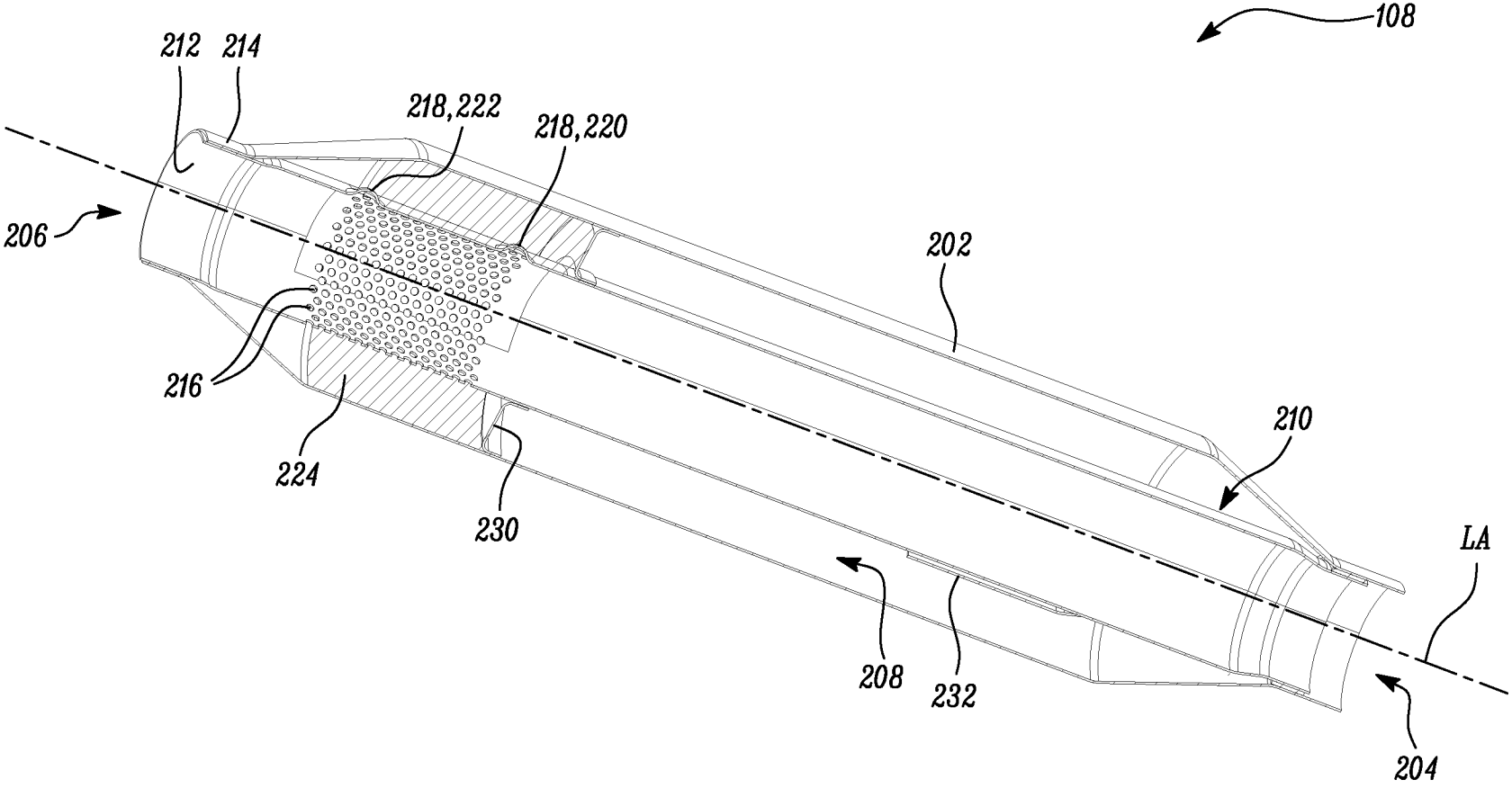
FIG. 4 is a sectional perspective view of the exhaust device of FIG. 2, according to an embodiment of the present disclosure.

FIG. 2 is a perspective view of the exhaust device 108, according to an embodiment of the present disclosure. FIG. 3 is a side sectional view of the exhaust device 108, according to an embodiment of the present disclosure. FIG. 4 is a sectional perspective view of the exhaust device 108, according to an embodiment of the present disclosure. In the illustrated embodiment of FIGS. 2 to 4, the exhaust device 108 is a resonator. Generally, in a vehicular exhaust system, the resonator is disposed upstream of a muffler, and it assists the muffler's objective of reducing a vehicle's noise. In some embodiments, the resonator is a part of the muffler.

The exhaust device 108 includes a casing 202 including an inlet 204 configured to receive an exhaust gas, an outlet 206 configured to discharge the exhaust gas, and a chamber 208 disposed therein between the inlet 204 and the outlet 206. The casing 202 is shown as transparent in FIG. 2 for illustrative purposes. The inlet 204 receives the exhaust gas from the exhaust components 104 and discharges the exhaust gas towards the tailpipe 106. The casing 202 defines a longitudinal axis LA along its length L1 (shown in FIG. 3). The casing 202 is preferably circular in cross section but can be of virtually any cross-section shape.

Figure 5:
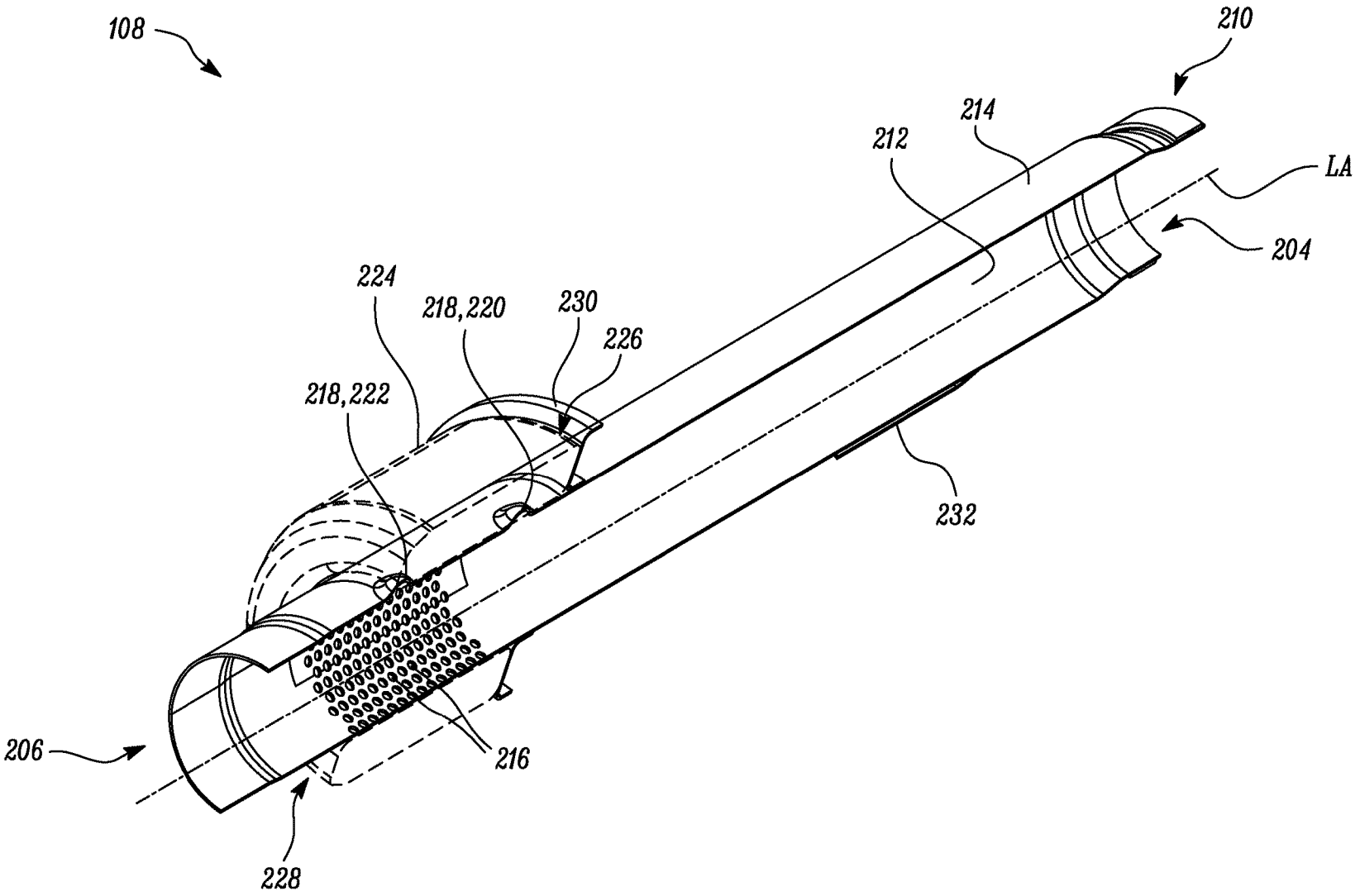
FIG. 5 is a sectional perspective view of the exhaust device of FIG. 2, with some components not shown, according to an embodiment of the present disclosure.

FIG. 5 is a sectional perspective view of the exhaust device 108, with some components not shown, according to an embodiment of the present disclosure. Specifically, the casing 202 is not shown in FIG. 5 for illustrative purposes.

Referring to FIGS. 2 to 5, the exhaust device 108 further includes an exhaust conduit 210 at least partially received within the chamber 208 of the casing 202 along the longitudinal axis LA. The exhaust conduit 210 has a length L2 along the longitudinal axis LA. In the illustrated embodiment of FIG. 3, the length L2 of the exhaust conduit 210 along the longitudinal axis LA is less than the length L1 of the casing 202, such that the exhaust conduit 210 is fully received within the chamber 208. In other embodiments, the exhaust conduit 210 can be only partially received within the chamber 208.

The exhaust conduit 210 includes an inner surface 212, an opposing outer surface 214, a plurality of perforations 216 extending through the exhaust conduit 210 from the inner surface 212 to the outer surface 214, and at least one protrusion 218 extending outwardly from the outer surface 214. In some embodiments, the at least one protrusion 218 is formed by punching the exhaust conduit 210. In some embodiments, the at least one protrusion 218 is welded to the outer surface 214 of the exhaust conduit 210. In the illustrated embodiment of FIGS. 2 to 5, the at least one protrusion 218 includes a first protrusion 220 and a second protrusion 222 spaced apart from the first protrusion 220 at least along the longitudinal axis LA. In other embodiments, the at least one protrusion 218 can include more than two protrusions spaced apart from each other at least along the longitudinal axis LA.

The exhaust device 108 further includes an absorptive material 224 disposed on the outer surface 214 of the exhaust conduit 210. The absorptive material 224 is shown as transparent in FIG. 5 for illustrative purposes. In the illustrated embodiment of FIGS. 2 to 5, the absorptive material 224 is in the form of a sleeve (i.e., a thick-walled cylinder). In other embodiments, the absorptive material 224 can be of other shapes, such as a U-shaped component disposed on the outer surface 214 of the exhaust conduit 210. The absorptive material 224 is disposed proximal to the outlet 206 of the casing 202 and distal to the inlet 204 of the casing 202. The absorptive material 224 is formed of a rolled sound absorbing material fitted around the outer surface 214 of the exhaust conduit 210. The absorptive material 224 is disposed around the outer surface 214 of the exhaust conduit 210 without using any carrier. The sound absorbing material can include one or more of fiberglass, mineral wool, glass wool, graphite, ceramic, polymer, etc.

Figure 6:
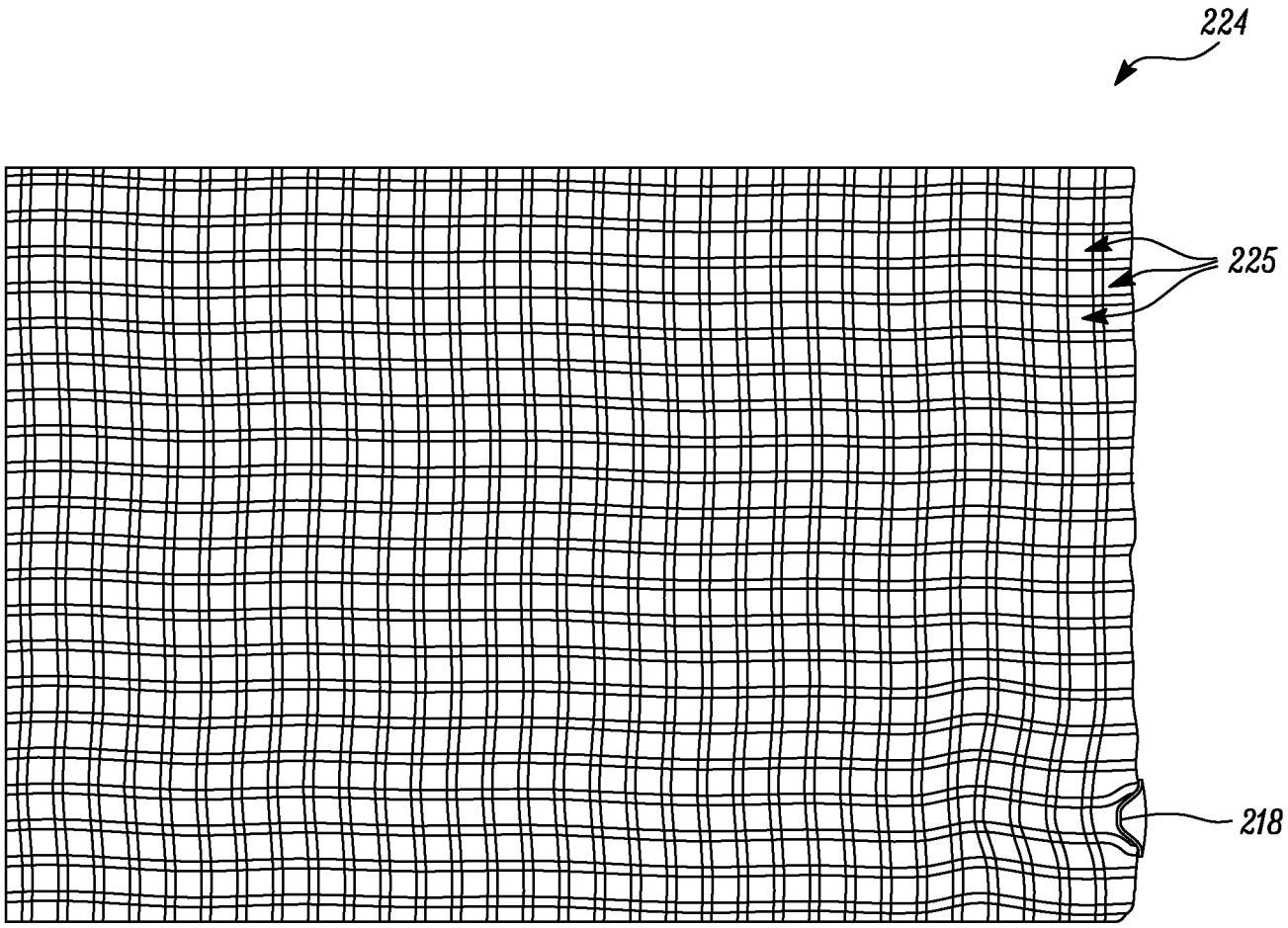
FIG. 6 is an enlarged view of a portion of an absorptive material of the exhaust device of FIG. 2, according to an embodiment of the present disclosure.

FIG. 6 is an enlarged view of a portion of the absorptive material 224, according to an embodiment of the present disclosure. In some embodiments, the absorptive material 224 can be like a bundle of fibers spun into a material that has a plurality of gaps 225 (or spaces) for the at least one protrusion 218 to project into. It is shown in FIG. 6 that the at least one protrusion 218 projects into at least one gap 225 from the plurality of gaps 225.

Referring to FIGS. 2 to 6, the exhaust device 108 further includes a partition plate 230 disposed around the outer surface 214 of the exhaust conduit 210 and received within the chamber 208. The partition plate 230 is disposed adjacent to a first end 226 of the absorptive material 224. The partition plate 230 can be disposed to form resonance chambers (not shown) divided by the partition plate 230.

The absorptive material 224 includes the first end 226 facing the inlet 204 of the casing 202 and an opposing second end 228 facing the outlet 206 of the casing 202. The plurality of perforations 216 of the exhaust conduit 210 are disposed between the inlet 204 of the casing 202 and the second end 228 of the absorptive material 224 relative to the longitudinal axis LA. In the illustrated embodiment of FIGS. 2 to 6, the plurality of perforations 216 of the exhaust conduit 210 are disposed between the first end 226 and the second end 228 of the absorptive material 224 relative to the longitudinal axis LA, such that the absorptive material 224 encloses the plurality of perforations 216. In other embodiments, the plurality of perforations 216 of the exhaust conduit 210 can be disposed between the inlet 204 of the casing 202 and the first end 226 of the absorptive material 224 relative to the longitudinal axis LA.

The at least one protrusion 218 is disposed at least partially between the first end 226 and the second end 228 of the absorptive material 224 relative to the longitudinal axis LA. The first protrusion 220 is disposed between the first end 226 and the second end 228 of the absorptive material 224. Further, the first protrusion 220 is proximal to the first end 226 of the absorptive material 224 and distal to the second end 228 of the absorptive material 224.

The second protrusion 222 is disposed at the second end 228 of the absorptive material 224. Specifically, the second protrusion 222 is disposed at least partially between the first end 226 and the second end 228 of the absorptive material 224 relative to the longitudinal axis LA. A portion of the second protrusion 222 is further disposed between the second end 228 of the absorptive material 224 and the outlet 206 of the casing 202 relative to the longitudinal axis LA.

The at least one protrusion 218 of the exhaust conduit 210 engages with and contacts the absorptive material 224 in order to form an interference fit between the absorptive material 224 and the exhaust conduit 210. In some examples, a height of the protrusion 218 can project into the absorptive material 224 or can compress the absorptive material 224 against an inner wall of the casing 202 to form the interference fit between the absorptive material 224 and the exhaust conduit 210. The interference fit prevents a relative movement between the absorptive material 224 and the exhaust conduit 210 at least along the longitudinal axis LA.

As the interference fit prevents the relative movement between the absorptive material 224 and the exhaust conduit 210 at least along the longitudinal axis LA, the absorptive material 224 may not slip off axially while performing the vertically downward stuffing of the exhaust conduit 210 within the casing 202. Therefore, the interference fit provided by including the at least one protrusion 218 can lead to a precise fitting of the exhaust conduit 210 and the absorptive material 224 within the casing 202 of the exhaust device 108.

Further, as the absorptive material 224 can be disposed and held firmly in its place around the exhaust conduit 210 during the stuffing of the exhaust conduit 210 within the casing 202, the exhaust device 108 can efficiently serve the purpose of deadening the exhaust sound generated by the engine 102 (shown in FIG. 1). In other words, the retention of the absorptive material 224 around the exhaust conduit 210 can enhance the ability of the exhaust device 108 to perform a desirable sound attenuation efficiently and effectively.

The interference fit can be formed by including only one protrusion 218 (i.e., the first protrusion 220 or the second protrusion 222) on the exhaust conduit 210. However, by including the two protrusions (i.e., the first protrusion 220 and the second protrusion 222), the absorptive material 224 can be firmly held in its place around the exhaust conduit 210 against gravity. Therefore, with an increase in number of protrusions, an ability of the exhaust conduit 210 to firmly hold the absorptive material 224 around the exhaust conduit 210 can be significantly improved thereby preventing the relative movement between the absorptive material 224 and the exhaust conduit 210 at least along the longitudinal axis LA.

Figure 7:
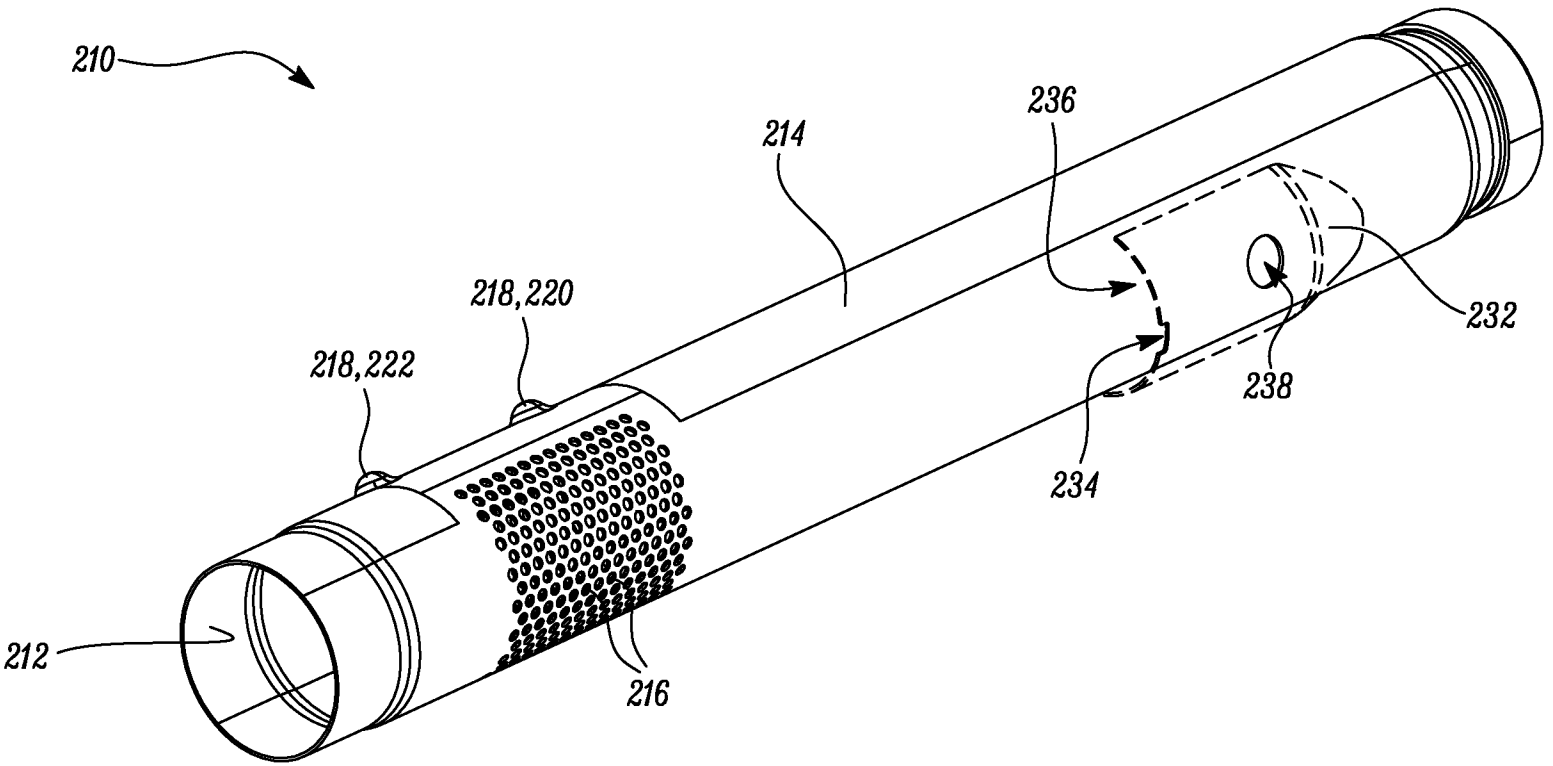
FIG. 7 is a perspective view of an exhaust conduit of the exhaust device of FIG. 2, according to an embodiment of the present disclosure.

FIG. 7 is a perspective view of the exhaust conduit 210, according to an embodiment of the present disclosure. With reference to FIGS. 2 to 7, the exhaust device 108 further includes a plate 232 fixedly attached to the outer surface 214 of the exhaust conduit 210 and spaced apart from the absorptive material 224 relative to the longitudinal axis LA. The plate 232 is shown transparent in FIG. 7 for illustrative purposes. The plate 232 is disposed proximal to the inlet 204 of the casing 202 and distal to the outlet 206 of the casing 202. Further, the plate 232 is disposed proximal to the first end 226 of the absorptive material 224 and distal to the second end 228 of the absorptive material 224.

The plate 232 and the outer surface 214 of the exhaust conduit 210 defines a slot 234 therebetween, such that the slot 234 includes at least one open end 236 disposed in fluid communication with the chamber 208. The exhaust conduit 210 further includes an opening 238 extending from the inner surface 212 to the outer surface 214 and disposed in fluid communication with the slot 234. Therefore, a portion of the exhaust gas can flow from the exhaust conduit 210 to the chamber 208 via the slot 234 defined between the plate 232 and the outer surface 214 of the exhaust conduit 210. Such flow of the exhaust gas from the exhaust conduit 210 to the chamber 208 can enhance sound attenuation.

Figure 8:
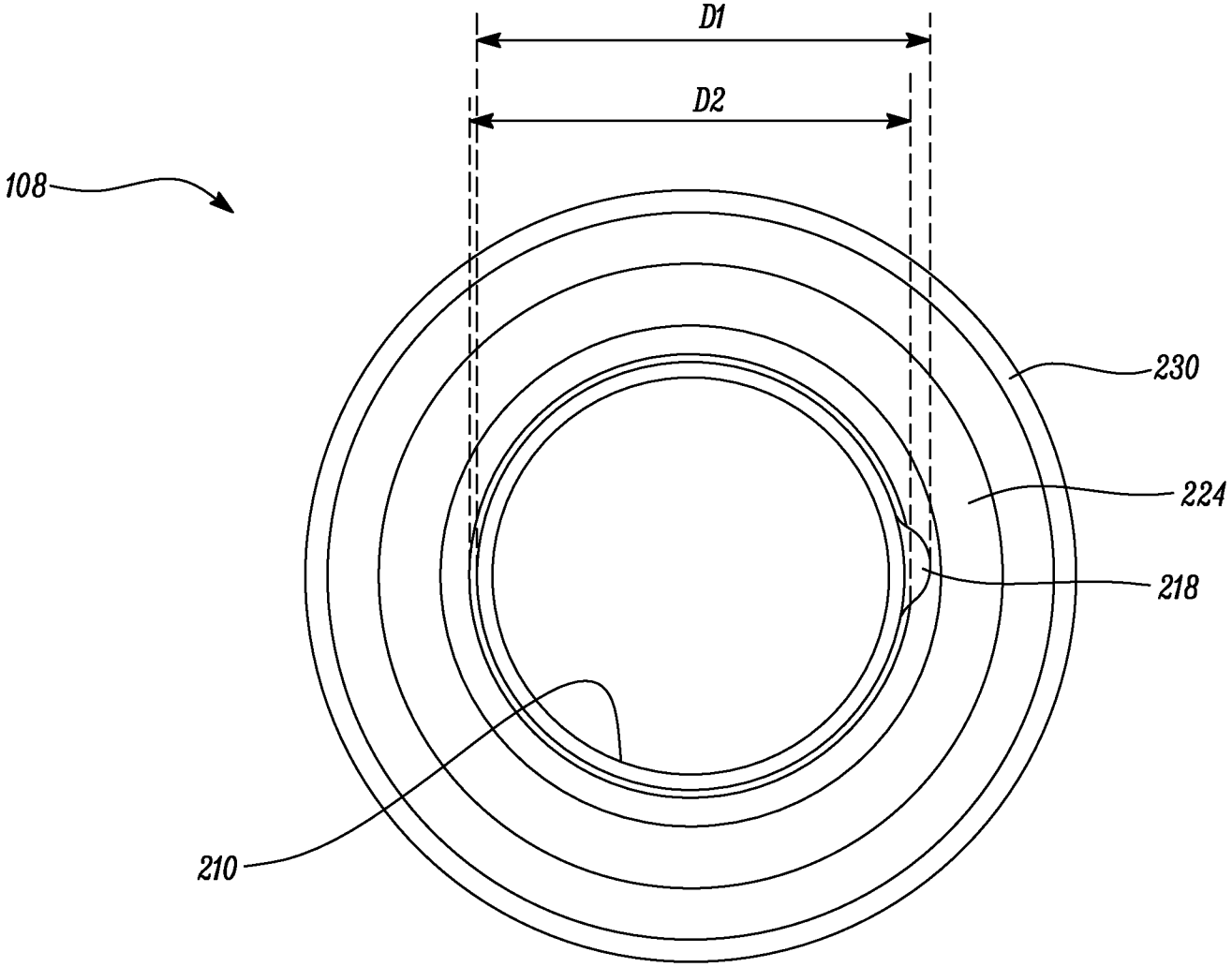
FIG. 8 is a front view of the exhaust device of FIG. 2, with some components not shown, according to an embodiment of the present disclosure.

FIG. 8 is a front view of the exhaust device 10, with some components not shown, according to an embodiment of the present disclosure. The casing 202 is not shown for illustrative purposes. With the inclusion of the at least one protrusion 218 on the exhaust conduit 210, the exhaust conduit 210 has a maximum outer diameter D1. Further, the absorptive material 224 has a minimum inner diameter D2. In the illustrated embodiment of FIG. 8, the maximum outer diameter D1 of the exhaust conduit 210 is greater than the minimum inner diameter D2 of the absorptive material 224. This is one of the reasons that the interference fit is formed between the absorptive material 224 and the exhaust conduit 210.

Figure 9:
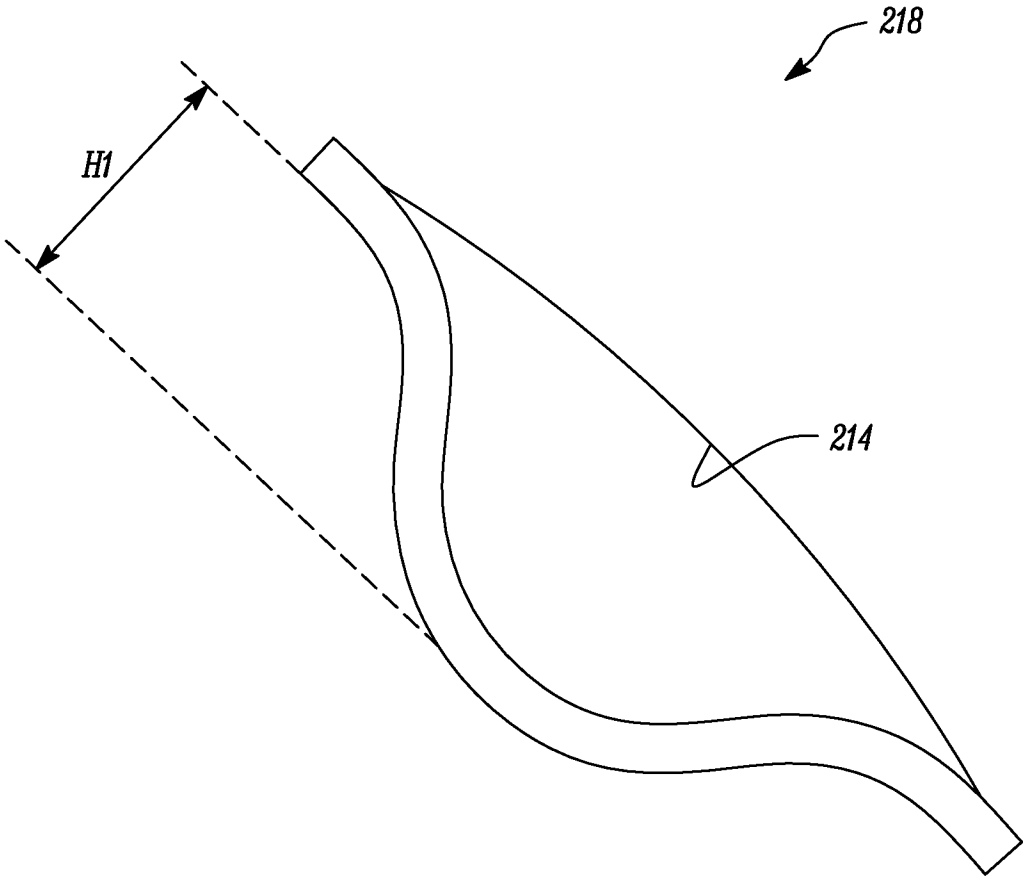
FIG. 9 is an enlarged view of at least one protrusion of the exhaust device of FIG. 2, according to an embodiment of the present disclosure.

FIG. 9 is a perspective view of the at least one protrusion 218, according to an embodiment of the present disclosure. In the illustrated embodiment of FIG. 9, the at least one protrusion 218 is dome shaped. In other embodiments, the at least one protrusion 218 can be of at least one shape selected from the group comprising of a circular shape, a quadrangular shape, a polygonal shape, an oval shape, a star shape, and combinations thereof. Further, a maximum height H1 of the at least one protrusion 218 from the outer surface 214 of the exhaust conduit 210 is from about 1 mm to about 10 mm.

In some embodiments, the maximum height H1 of the at least one protrusion 218 is about 5 mm.

Figure 10:
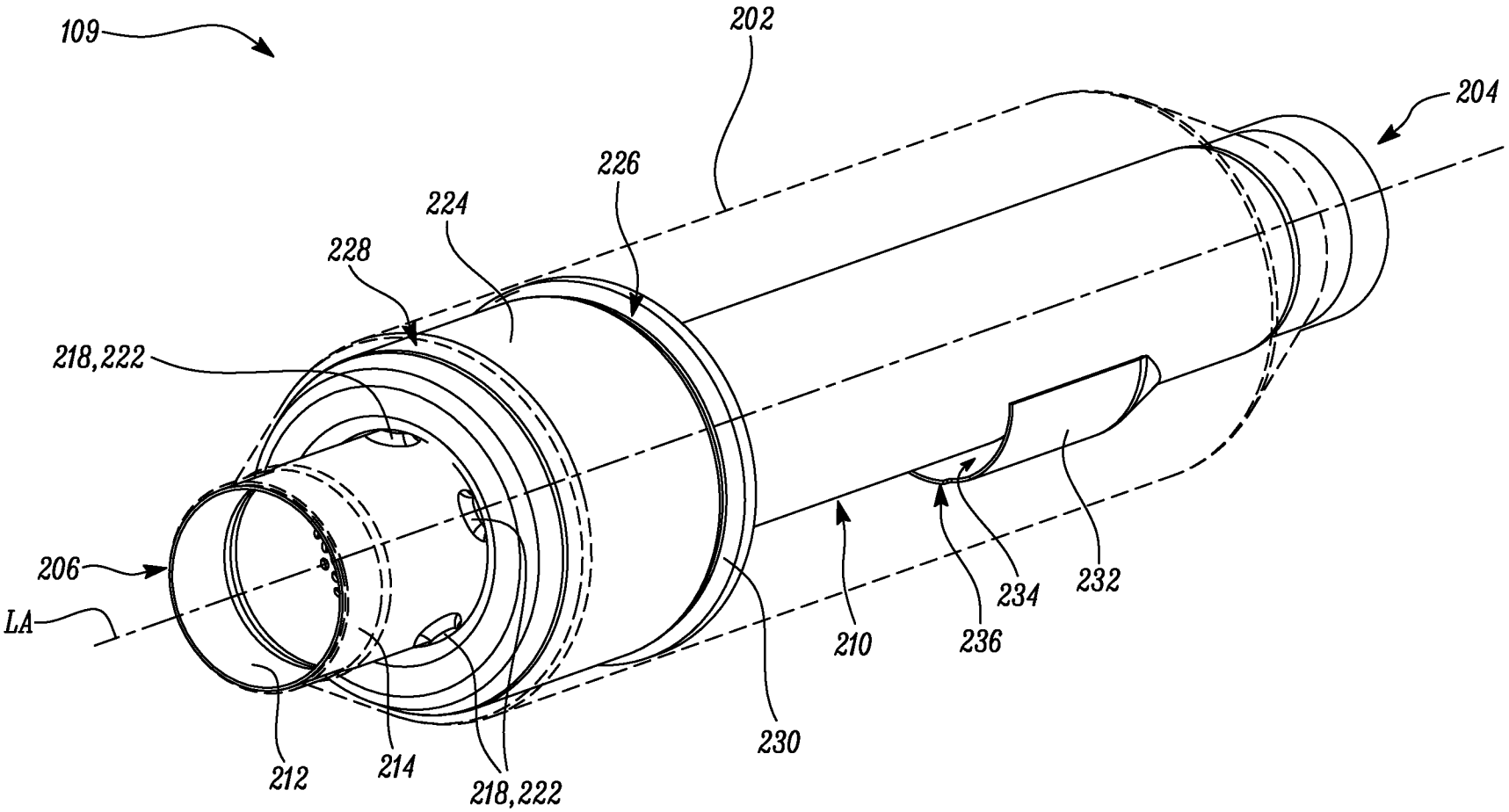
FIG. 10 is a perspective view of an exhaust device of the vehicle exhaust system of FIG. 1, according to another embodiment of the present disclosure.

FIG. 10 is a perspective view of an exhaust device 109, according to an embodiment of the present disclosure. The exhaust device 109 is substantially similar to the exhaust device 108 illustrated in FIG. 2. Common components between the exhaust device 108 and the exhaust device 109 are illustrated by the same reference numerals. However, in the exhaust device 109, the at least one protrusion 218 includes a plurality of protrusions 218 disposed circumferentially around the longitudinal axis LA. In the illustrated embodiment of FIG. 10, the at least one protrusion 218 includes one first protrusion 220 (not shown in FIG. 10) disposed between the first end 226 and the second end 228 of the absorptive material 224 and a total of three second protrusions 222 disposed circumferentially around the longitudinal axis LA at the second end 228 of the absorptive material 224. In other embodiments, the at least one protrusion 218 can include more than three second protrusions 222 disposed circumferentially around the longitudinal axis LA.

Figure 11:
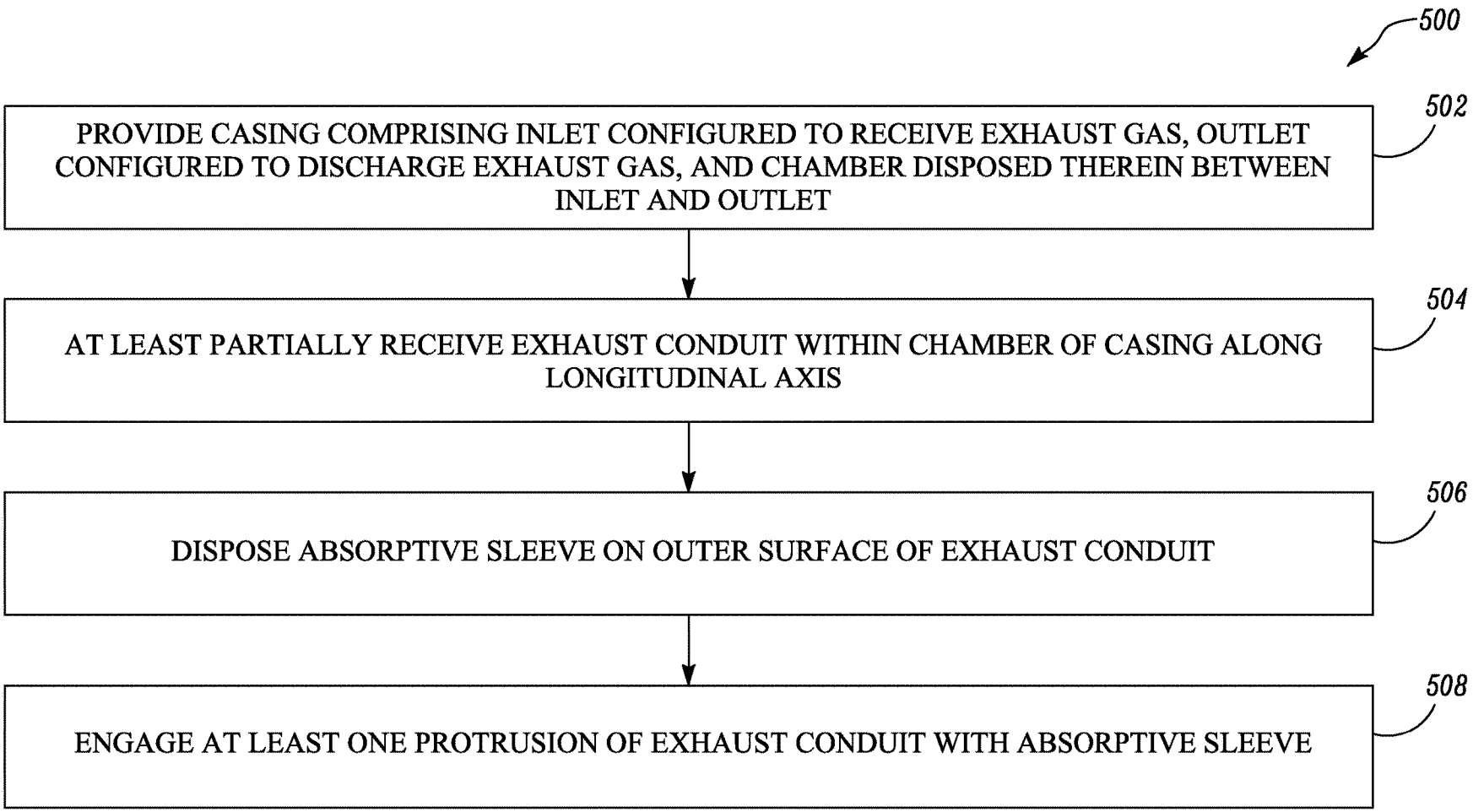
FIG. 11 is a flowchart of a method for manufacturing the exhaust device of FIG. 2, according to an embodiment of the present disclosure.

FIG. 11 is a flowchart of a method 500 for manufacturing the exhaust device 108 (shown in FIGS. 2 to 5), according to an embodiment of the present disclosure. The method 500 can also be used for manufacturing the exhaust device 109 (shown in FIG. 10). Referring to FIGS. 2 to 11, at step 502, the method 500 includes providing the casing 202 including the inlet 204 configured to receive the exhaust gas, the outlet 206 configured to discharge the exhaust gas, and the chamber 208 disposed therein between the inlet 204 and the outlet 206.

At step 504, the method 500 further includes at least partially receiving the exhaust conduit 210 within the chamber 208 of the casing 202 along the longitudinal axis LA. At step 506, the method 500 further includes disposing the absorptive material 224 on the outer surface 214 of the exhaust conduit 210. At step 508, the method 500 further includes engaging the at least one protrusion 218 of the exhaust conduit 210 with the absorptive material 224 in order to form the interference fit between the absorptive material 224 and the exhaust conduit 210.

In some embodiments, the method 500 further includes punching the exhaust conduit 210 to form the at least one protrusion 218. In some other embodiments, the method 500 further includes welding the at least one protrusion 218 to the outer surface 214 of the exhaust conduit 210. In some embodiments, engaging the at least one protrusion 218 of the exhaust conduit 210 with the absorptive material 224 further includes engaging each of the first protrusion 220 and the second protrusion 222 with the absorptive material 224.

While aspects of the present disclosure have been particularly shown and described with reference to the embodiments above, it will be understood by those skilled in the art that various additional embodiments can be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An exhaust device comprising:

a casing comprising an inlet configured to receive an exhaust gas, an outlet configured to discharge the exhaust gas, and a chamber disposed therein between the inlet and the outlet, the casing defining a longitudinal axis along its length;

an exhaust conduit at least partially received within the chamber of the casing along the longitudinal axis, the exhaust conduit comprising an inner surface, an opposing outer surface, a plurality of perforations extending through the exhaust conduit from the inner surface to the outer surface, and at least one protrusion extending outwardly from the outer surface and spaced from the plurality of perforations;

an absorptive material disposed on the outer surface of the exhaust conduit, the absorptive material comprising a first end facing the inlet of the casing and an opposing second end facing the outlet of the casing; and a plate fixedly attached to the outer surface of the exhaust conduit and spaced apart from the absorptive material relative to the longitudinal axis, wherein the plate and the outer surface of the exhaust conduit defines a slot therebetween, such that the slot comprises at least one open end disposed in fluid communication with the chamber, and wherein the exhaust conduit further comprises an opening extending from the inner surface to the outer surface and disposed in fluid communication with the slot;

wherein the plurality of perforations of the exhaust conduit are disposed between the inlet of the casing and the second end of the absorptive material relative to the longitudinal axis; and wherein the at least one protrusion of the exhaust conduit engages with the absorptive material in order to form an interference fit between the absorptive material and the exhaust conduit, wherein the interference fit prevents a relative movement between the absorptive material and the exhaust conduit at least along the longitudinal axis.

2. The exhaust device of claim 1, wherein the plurality of perforations of the exhaust conduit are disposed between the first end and the second end of the absorptive material relative to the longitudinal axis, such that the absorptive material encloses the plurality of perforations.

3. The exhaust device of claim 1, wherein the at least one protrusion is disposed at least partially between the first end and the second end of the absorptive material relative to the longitudinal axis.

4. The exhaust device of claim 1, wherein the at least one protrusion comprises a first protrusion and a second protrusion spaced apart from the first protrusion at least along the longitudinal axis, wherein the first protrusion is disposed between the first end and the second end of the absorptive material, and wherein the second protrusion is disposed at the second end of the absorptive material.

5. The exhaust device of claim 4, wherein the first protrusion is proximal to the first end of the absorptive material and distal to the second end of the absorptive material.

6. The exhaust device of claim 1, further comprising a partition plate disposed around the outer surface of the exhaust conduit and received within the chamber, wherein the partition plate is disposed adjacent to the first end of the absorptive material.

7. The exhaust device of claim 1, wherein the at least one protrusion comprises a plurality of protrusions disposed circumferentially around the longitudinal axis.

8. The exhaust device of claim 1, wherein the at least one protrusion is formed by punching the exhaust conduit.

9. The exhaust device of claim 1, wherein the at least one protrusion is welded to the outer surface of the exhaust conduit.

10. The exhaust device of claim 1, wherein the plate is disposed proximal to the inlet of the casing and distal to the outlet of the casing.

11. The exhaust device of claim 1, wherein the absorptive material is disposed proximal to the outlet of the casing and distal to the inlet of the casing.

12. The exhaust device of claim 1, wherein a maximum outer diameter of the exhaust conduit is greater than a minimum inner diameter of the absorptive material.

13. The exhaust device of claim 1, wherein the at least one protrusion is dome shaped.

14. The exhaust device of claim 1, wherein a maximum height of the at least one protrusion from the outer surface of the exhaust conduit is from 1 mm to 10 mm.

15. The exhaust device of claim 1, wherein a length of the exhaust conduit along the longitudinal axis is less than the length of the casing, such that the exhaust conduit is fully received within the chamber.

16. The exhaust device of claim 1, wherein the at least one protrusion of the exhaust conduit engages with the absorptive material and compresses the absorptive material against an inner wall of the casing in order to form an interference fit between the absorptive material, the casing and the exhaust conduit.

17. An exhaust device comprising:

a casing comprising an inlet configured to receive an exhaust gas, an outlet configured to discharge the exhaust gas, and a chamber disposed therein between the inlet and the outlet, the casing defining a longitudinal axis along its length;

an exhaust conduit at least partially received within the chamber of the casing along the longitudinal axis, the exhaust conduit comprising an inner surface, an opposing outer surface, a plurality of perforations extending through the exhaust conduit from the inner surface to the outer surface, and at least one protrusion extending outwardly from the outer surface;

an absorptive material disposed on the outer surface of the exhaust conduit, the absorptive material comprising a first end facing the inlet of the casing and an opposing second end facing the outlet of the casing; and a plate fixedly attached to the outer surface of the exhaust conduit and spaced apart from the absorptive material relative to the longitudinal axis, wherein the plate and the outer surface of the exhaust conduit defines a slot therebetween, such that the slot comprises at least one open end disposed in fluid communication with the chamber, and wherein the exhaust conduit further comprises an opening extending from the inner surface to the outer surface and disposed in fluid communication with the slot;

wherein the plurality of perforations of the exhaust conduit are disposed between the inlet of the casing and the second end of the absorptive material relative to the longitudinal axis; and wherein the at least one protrusion of the exhaust conduit engages with the absorptive material in order to form an interference fit between the absorptive material and the exhaust conduit, wherein the interference fit prevents a relative movement between the absorptive material and the exhaust conduit at least along the longitudinal axis.

18. The exhaust device of claim 17, wherein the plurality of perforations of the exhaust conduit are disposed between the first end and the second end of the absorptive material relative to the longitudinal axis, such that the absorptive material encloses the plurality of perforations.

19. The exhaust device of claim 17, wherein the at least one protrusion is disposed at least partially between the first end and the second end of the absorptive material relative to the longitudinal axis.

20. The exhaust device of claim 17, wherein the at least one protrusion comprises a first protrusion and a second protrusion spaced apart from the first protrusion at least along the longitudinal axis, wherein the first protrusion is disposed between the first end and the second end of the absorptive material, and wherein the second protrusion is disposed at the second end of the absorptive material.

21. The exhaust device of claim 17, further comprising a partition plate disposed around the outer surface of the exhaust conduit and received within the chamber, wherein the partition plate is disposed adjacent to the first end of the absorptive material.

* * * * *